US012203330B2

(12) United States Patent
Ali et al.

(10) Patent No.: US 12,203,330 B2
(45) Date of Patent: Jan. 21, 2025

(54) CUTTING A WELLBORE TUBULAR

(71) Applicant: Saudi Arabian Oil Company, Dhahran (SA)

(72) Inventors: Amin Taha Ali, Al-Khobar (SA); Abdullah Mohammed Aldejani, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/143,323

(22) Filed: May 4, 2023

(65) Prior Publication Data

US 2024/0368954 A1 Nov. 7, 2024

(51) Int. Cl.

| | |
|---|---|
| ***E21B 29/00*** | (2006.01) |
| ***E21B 4/02*** | (2006.01) |
| ***E21B 10/00*** | (2006.01) |

(52) U.S. Cl.

CPC ..... *E21B 29/005* (2013.01); *E21B 4/02* (2013.01); *E21B 10/003* (2013.01)

(58) Field of Classification Search

CPC ..... E21B 29/005; E21B 29/002; E21B 4/02
See application file for complete search history.

(56) References Cited

U.S. PATENT DOCUMENTS

| | | | |
|---|---|---|---|
| 2,136,518 A | 11/1938 | Nixon | |
| 4,141,421 A | 2/1979 | Gardner | |
| 7,410,015 B2 | 8/2008 | Denoix | |
| 2013/0199785 A1 | 8/2013 | Hekelaar | |
| 2020/0149365 A1* | 5/2020 | Wilson | E21B 29/005 |

FOREIGN PATENT DOCUMENTS

| | | |
|---|---|---|
| CA | 2085207 | 1/1997 |
| CA | 2837958 | 6/2019 |
| DE | 1758065 | 12/1970 |
| WO | WO 2012164023 | 12/2012 |

* cited by examiner

*Primary Examiner* — Tara Schimpf
*Assistant Examiner* — Ursula Lee Norris
(74) *Attorney, Agent, or Firm* — Fish & Richardson P.C.

(57) ABSTRACT

A downhole tool includes a housing; a seal that at least partially circumscribes an external surface of the housing and is configured to fluidly seal the housing against a wellbore tubular positioned in a wellbore; a hydraulic motor assembly positioned in the housing and including a hydraulic rotor fluidly coupled to an opening in the housing and a shaft coupled to the hydraulic rotor; and a tubular cutting assembly coupled to the hydraulic motor assembly. The tubular cutting assembly includes a bearing coupled to the shaft, and at least one cutting blade coupled to the bearing and operable to cut the wellbore tubular. The at least one cutting blade is configured to rotate in an extended position from the external surface of the housing in response to a flow of wellbore fluid circulated through the wellbore tubular and to the hydraulic motor assembly through the opening in the housing.

20 Claims, 3 Drawing Sheets

CUTTING A WELLBORE TUBULAR

TECHNICAL FIELD

This disclosure relates to apparatus, systems, and methods for cutting a wellbore tubular in a wellbore.

BACKGROUND

In oil and gas exploration and development operations, it may be desirable to cut and remove tubing that, for example, has previously been set in a wellbore as part of a well de-completion procedure or while drilling to cut and free stuck drill pipes. This can be a complex and expensive process.

SUMMARY

In an example implementation, a downhole tool includes a housing; a seal that at least partially circumscribes an external surface of the housing and is configured to fluidly seal the housing against a wellbore tubular positioned in a wellbore that extends from a terranean surface into one or more subterranean formations; a hydraulic motor assembly positioned in the housing and including a hydraulic rotor fluidly coupled to an opening in the housing and a shaft coupled to the hydraulic rotor; and a tubular cutting assembly coupled to the hydraulic motor assembly. The tubular cutting assembly includes a bearing coupled to the shaft, and at least one cutting blade coupled to the bearing and operable to cut the wellbore tubular. The at least one cutting blade is configured to rotate in an extended position from the external surface of the housing in response to a flow of wellbore fluid circulated through the wellbore tubular and to the hydraulic motor assembly through the opening in the housing.

In an aspect combinable with the example implementation, the housing includes a hanger assembly configured to attach to an inner surface of the wellbore tubular.

In another aspect combinable with any of the previous aspects, the hanger assembly includes one or more slips.

In another aspect combinable with any of the previous aspects, the housing is configured to move through the wellbore untethered to a downhole conveyance.

In another aspect combinable with any of the previous aspects, the housing is configured to couple to a downhole conveyance and move through the wellbore attached to the downhole conveyance.

In another aspect combinable with any of the previous aspects, the downhole conveyance includes a wireline or a slickline.

In another aspect combinable with any of the previous aspects, the housing includes a conical downhole end configured to seat into a nipple positioned in the wellbore tubular.

In another aspect combinable with any of the previous aspects, the wellbore tubular includes a production tubular string.

Another aspect combinable with any of the previous aspects includes a cutting head that is included of the conical downhole end and includes the tubular cutting assembly.

In another aspect combinable with any of the previous aspects, the at least one cutting blade is configured to adjust from the extended position to a retracted position within the housing in response to stopping the flow of wellbore fluid.

In another example implementation, a method for cutting a wellbore tubular includes running a downhole tool into a wellbore that extends from a terranean surface into one or more subterranean formations. The downhole tool includes a housing; a seal that at least partially circumscribes an external surface of the housing; a hydraulic motor assembly positioned in the housing and including a hydraulic rotor fluidly coupled to an opening in the housing and a shaft coupled to the hydraulic rotor; and a tubular cutting assembly coupled to the hydraulic motor assembly. The tubular cutting assembly includes a bearing coupled to the shaft, and at least one cutting blade coupled to the bearing. The method includes moving the downhole tool through the wellbore such that the housing is fluidly sealed against the wellbore tubular with the seal; circulating a flow of wellbore fluid through the wellbore tubular and to the hydraulic motor assembly through an opening in the housing; rotating, with the flow of wellbore fluid, the hydraulic rotor to rotate the shaft; extending the at least one cutting blade from an external surface of the housing in response to rotating the shaft; and cutting at least a portion of the wellbore fluid with the extended at least one cutting blade.

An aspect combinable with the example implementation includes securing the housing to an inner surface of the wellbore tubular with a hanger assembly.

In another aspect combinable with any of the previous aspects, the hanger assembly includes one or more slips.

Another aspect combinable with any of the previous aspects includes moving the housing through the wellbore untethered to a downhole conveyance.

Another aspect combinable with any of the previous aspects includes moving the housing through the wellbore attached to the downhole conveyance.

In another aspect combinable with any of the previous aspects, the downhole conveyance includes a wireline or a slickline.

Another aspect combinable with any of the previous aspects includes seating a conical downhole end of the housing into a nipple positioned in the wellbore tubular.

In another aspect combinable with any of the previous aspects, the wellbore tubular includes a production tubular string.

In another aspect combinable with any of the previous aspects, the downhole tool further includes a cutting head that is included of the conical downhole end and includes the tubular cutting assembly.

Another aspect combinable with any of the previous aspects includes stopping the flow of wellbore fluid through the wellbore tubular and to the hydraulic motor assembly; and retracting the at least one cutting blade into the housing in response to stopping the flow of wellbore fluid.

Implementations of wellbore tubular cutting apparatus, systems, and methods according to the present disclosure may include one or more of the following features. For example, implementations according to the present disclosure can provide for a drop in, untethered downhole tool that is operable to cut production tubing in a single downhole trip. As another example, implementations according to the present disclosure can cut stuck wellbore tubulars at a higher cost efficiency as compared to conventional tools.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes example implementations of a downhole tool for cutting a wellbore tubular such as, for example, a production tubing that is installed in a wellbore. In some aspects, example implementations of a downhole tool according to the present disclosure can be dropped from a terranean surface (in other words, untethered to a downhole conveyance) into the wellbore and land over an existing completion component (such as a completion nipple) and cut the production tubing uphole of the completion component. Alternatively, example implementations of a downhole tool according to the present disclosure can be deployed in the wellbore connected to a downhole conveyance, such as wireline or slick line. In some aspects, circulation of a wellbore fluid (such as drilling fluid or "mud") can flow through the downhole tool to generate a centrifugal or inertial force (with a hydraulic motor) that causes one or more rotating cutting blades to extend from the tool to cut the production tubing. In some aspects, upon completion of the cut, flow of the wellbore fluid can cease, thereby reducing or stopping the inertial force to allow the one or more cutting blades to retract into a housing of the tool. Ultimately, the cutter will be Pull out with cut off tubing and lay down.

Figure 1:
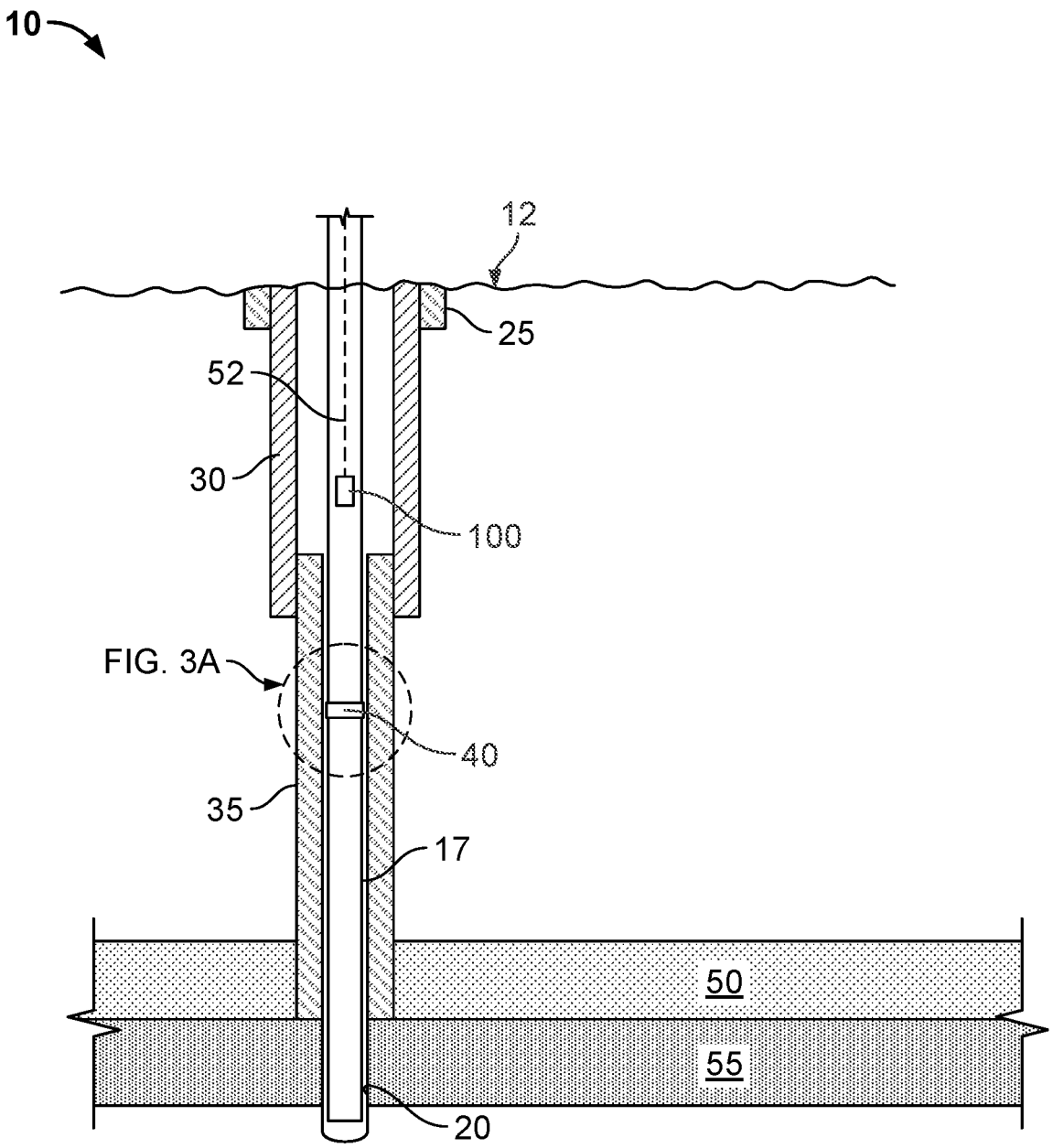
FIG. 1 is a schematic diagram of a downhole tool for cutting a wellbore tubular according to the present disclosure.

FIG. 1 illustrates an example implementation of a wellbore completion system 10 that includes a downhole tool 100 operable to cut a wellbore tubular according to the present disclosure. The downhole tool 100 illustrated in FIG. 1 can be run into wellbore 20 that is formed from a terranean surface 12 to one or more subterranean formations 50 and 55 (as examples) either as an untethered downhole tool 100 or connected to a downhole conveyance 52 (optionally). The downhole conveyance 52 can be a slickline, for example, or other form of conveyance (such as a wirelines or otherwise). When positioned within a wellbore tubular 17 at a particular position (in other words, depth), the downhole tool 100 can be operated to cut the wellbore tubular 17 as described herein.

As shown, the wellbore system 10 accesses one or more subterranean formations 50 and 55 to produce hydrocarbons located in such subterranean formations. As illustrated in FIG. 1, the wellbore 20 can be formed with a drilling assembly (not shown) deployed on the terranean surface 12. As will be explained in more detail, one or more wellbore casings, such as a surface casing 30 and intermediate casing 35, may be installed in at least a portion of the wellbore 20.

In some embodiments, the drilling assembly (as well as other completion equipment associated with running the downhole tool 100 into the wellbore 20) can be deployed on a body of water rather than the terranean surface 12. For instance, in some embodiments, the terranean surface 12 may be below an ocean, gulf, sea, or any other body of water under which hydrocarbon-bearing formations may be found. In short, reference to the terranean surface 12 includes both land and underwater surfaces and contemplates forming or developing one or more wellbores from either or both locations.

Generally, a drilling assembly that forms wellbore 20 can be any appropriate assembly or drilling rig used to form wellbores or boreholes in the Earth. The drilling assembly can use traditional techniques to form such wellbores, such as the wellbore 20, or can use nontraditional or novel techniques. In some embodiments, the drilling assembly can use rotary drilling equipment to form such wellbores. Rotary drilling equipment is known and can consist of a drill string and a bottom hole assembly (BHA). In some embodiments, the drilling assembly 15 can consist of a rotary drilling rig. Rotating equipment on such a rotary drilling rig can consist of components that serve to rotate a drill bit, which in turn forms a wellbore, such as the vertical wellbore portion 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drill string. The drill string is typically attached to the drill bit within the BHA. A swivel, which is attached to hoisting equipment, carries much, if not all of, the weight of the drill string, but can allow it to rotate freely.

In some embodiments of the wellbore system 10, the wellbore 20 can be cased with one or more casings. As illustrated, the wellbore 20 includes a conductor casing 25, which extends from the terranean surface 12 shortly into the Earth. A portion of the wellbore portion 20 enclosed by the conductor casing 25 can be a large diameter borehole. Downhole of the conductor casing 25 can be the surface casing 30. The surface casing 30 can enclose a slightly smaller borehole and protect the wellbore 20 from intrusion of, for example, freshwater aquifers located near the terranean surface 12.

Although illustrated as vertical, the wellbore 20 can be offset from vertical (for example, a slant wellbore), a directional wellbore, a horizontal wellbore, or combinations of several of these types of wellbore. For example, the wellbore 20 can be a stepped wellbore, such that a portion is drilled vertically downward and then curved to a horizontal wellbore portion. The horizontal wellbore portion can then be turned downward to a second substantially vertical portion, which is then turned to a second substantially horizontal wellbore portion. Additional vertical and horizontal wellbore portions can be added according to, for example, the type of terranean surface 12, the depth of one or more target subterranean formations, or the depth of one or more productive subterranean formations, or a combination of both.

Figures 3A, 3B, 3C, 3D:
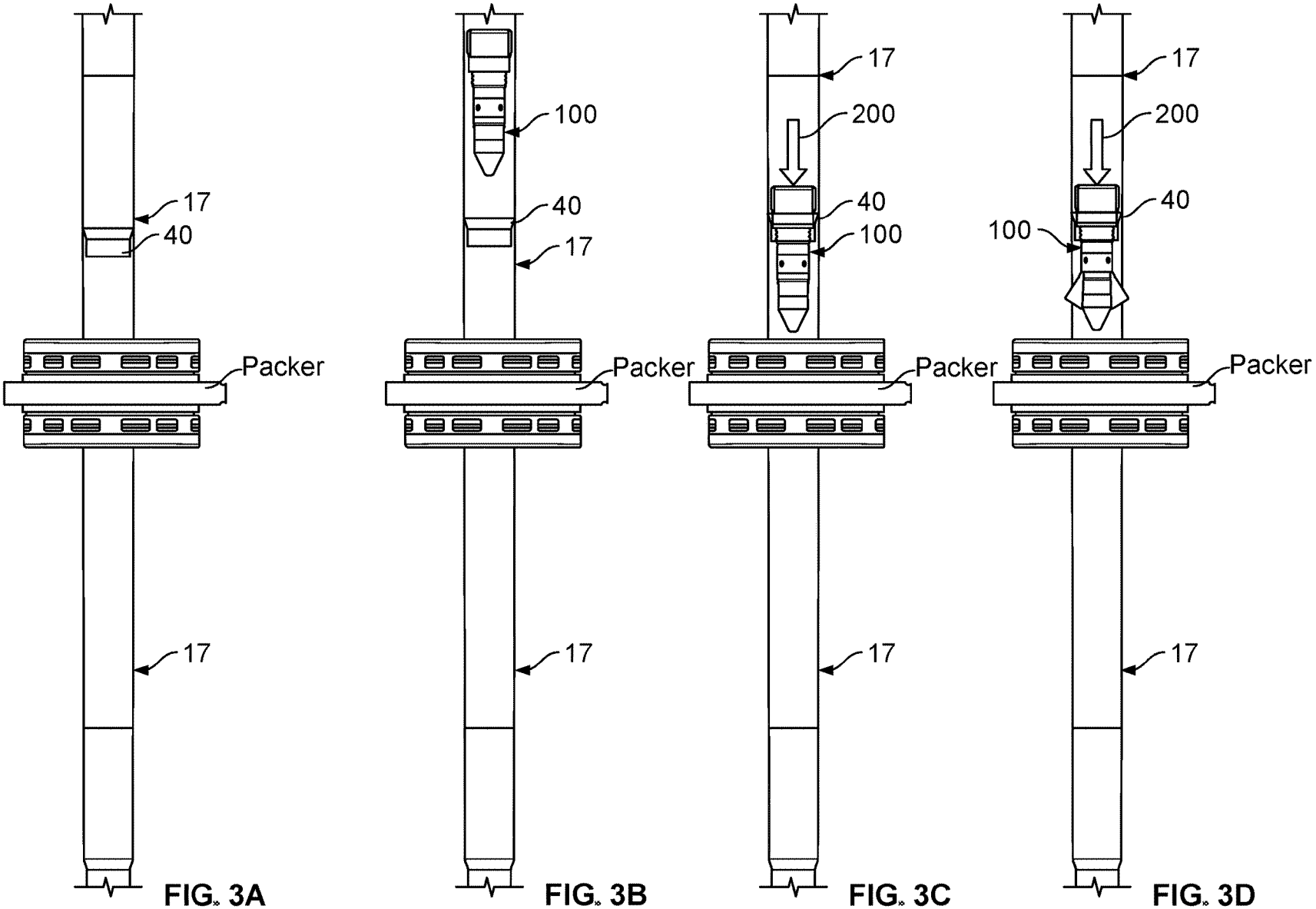
FIGS. 3A-3D illustrate an example implementation of a process for cutting a wellbore tubular with a downhole tool according to the present disclosure.

Once the wellbore 20 is completed, a wellbore tubular 17, such as a production tubing 17, can be installed in the wellbore 20 from the terranean surface 12 into and through one or more of the subterranean formations 50 and 55. The wellbore tubular 17 can be made up of multiple joints of tubing that connect (for example, threadingly) together to form the production tubing 17. As shown in this example, production tubing 17 can have one or more completion components installed therein, such as completion component 40. In some aspects, as shown in FIG. 3A for example, the completion component 40 can be a tubing nipple 40 that connects two joints of the production tubing 17.

Figures 2A, 2B:
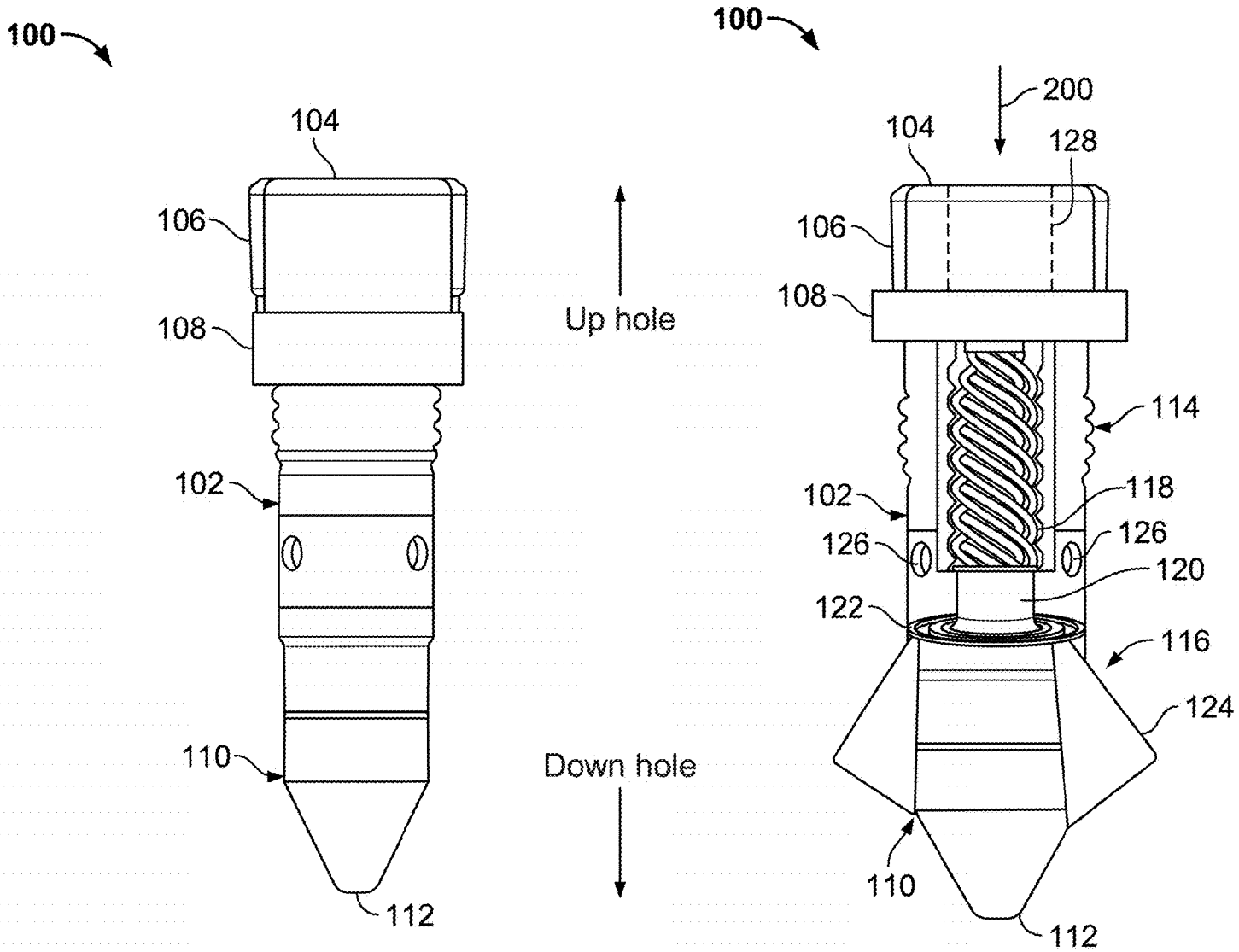
FIG. 2A is a schematic diagram of an example implementation of a downhole tool for cutting a wellbore tubular in which the downhole tool is in a retracted position according to the present disclosure.
FIG. 2B is a schematic diagram of an example implementation of a downhole tool for cutting a wellbore tubular in which the downhole tool is in an extended position according to the present disclosure.

FIG. 2A is a schematic diagram of an example implementation of the downhole tool 100 for cutting a wellbore tubular in which the downhole tool 100 is in a retracted position according to the present disclosure. FIG. 2B is a schematic diagram of the example implementation of the downhole tool 100 for cutting a wellbore tubular in which the downhole tool is in an extended position according to the present disclosure. As shown in these figures, downhole tool 100 includes a housing 102 that includes an opening 104 to a bore 128 at an uphole end and a conical downhole end 112. Thus, housing 102 generally is formed as a streamlined housing that can move (for example, untethered to any downhole conveyance in some aspects) through a wellbore, such as through a fluid in a wellbore.

At the uphole end of the housing 102, the downhole tool 100 includes a hanger 106 that circumscribes at least a portion of the housing 102. In some aspects, the hanger 106 is or includes a profile or slips that can engage, for example, the tubing nipple 40 when the downhole tool 100 lands in the nipple 40. In some aspects, the hanger 106 has a larger outer diameter (OD) than an inner diameter (ID) of the nipple 40 to facilitate landing of the downhole tool 100 on the nipple 40. As noted, slips in the hanger 106 can provide greater attachment for the downhole tool 100 when it lands on the nipple 40.

As shown in these figures, adjacent the hanger 106 is a seal 108. The seal 108 can operate or be sized to fluidly decouple a volume of the wellbore tubular 17 that is uphole of the seal 108 with a volume of the wellbore tubular 17 that is downhole of the seal 108 when the downhole tool 100 lands on the nipple 40. Thus, the seal 108 seals between the housing 102 and the nipple 40 to ensure that a wellbore fluid 200 that is circulated to the downhole tool 100 to operate the downhole tool 100 in a cutting operation (as described more fully herein) is directed into the bore 128, rather than between the housing 102 and the wellbore tubular 17. The seal 108 can also circumscribe at least a portion of the housing 102.

The conical downhole end 112 of the housing 102, in this example implementation, is part of a cutting head 110. Turning particularly to FIG. 2B, an inner volume of the housing 102 is exposed to illustrate a hydraulic motor assembly 114 and a cutting assembly 116 of the downhole tool 100. In this example, the hydraulic motor assembly 114 includes a hydraulic rotor 118 that is driveably coupled to a shaft 120 within the housing 102. As shown, the hydraulic rotor 118 is fluidly coupled to the bore 128 such that the wellbore fluid 200 (for example, drilling fluid or "mud") can be circulated into the housing 102 through the bore 128 and to the hydraulic rotor 118.

Near a downhole end of the hydraulic rotor 118 is one or more relief ports 126 formed in the housing 102. The relief port(s) 126, in this example, also fluidly couple the inner volume of the housing 102 at the downhole end of the hydraulic rotor 118 with a volume of the wellbore tubular 17. In some aspects, as the wellbore fluid 200 is circulated through the housing 102 to drive (for example, rotate or spin) the hydraulic rotor 118, the relief port(s) 126 can provide an exit from the housing 102 for the circulated wellbore fluid 200, as well as equalize a pressure inside the housing 102 with a pressure outside of the housing 102 (in other words, the wellbore pressure in the wellbore tubular 17).

In this example implementation, the cutting assembly 116 includes one or more cutting blades 124 and a roller bearing 122 that couples the cutting head 110 to the shaft 120. The cutting blade(s) 124 can be stored all or partially in the cutting head 110 in a retracted position as shown in FIG. 2A. In an extended position, as shown in FIG. 2B, the one or more cutting blades 124 extend from the cutting head 110 in order to cut through the wellbore tubular 17. As explained in more detail with respect to FIGS. 3A-3D, as the wellbore fluid 200 is circulated to the downhole tool 100 and into the bore 128 to drive the hydraulic rotor 118, the rotor 118 then drives the shaft 120 that, in turn, drives the cutting head 110 through the roller bearing 122. As the cutting head 110 rotates, the one or more cutting blades 124 move (for example, through centrifugal or inertial force) from the retracted position within the cutting head 110 to the extended position external to the cutting head 110. Upon cessation of the circulation of the wellbore fluid 200 to the downhole tool 100, the centrifugal or inertial force is reduced or removed, thereby allowing the one or more cutting blades 124 to move from the extended position back to the retracted position within the cutting head 110. As shown, the cutting blade(s) 124 can be coupled (for example, indirectly) to the roller bearing 122 by virtue of being part of the cutting head 110. Alternatively, in implementations without a rotatable cutting head 110, the cutting blade(s) 124 can be coupled (for example, directly) to the roller bearing 122 and thus to the shaft 120.

FIGS. 3A-3D illustrate an example implementation of a process for cutting the wellbore tubular 17 with the downhole tool 100 according to the present disclosure. For example, turning to FIG. 3A, the wellbore tubular 17 is shown in the wellbore 20 with the tubing nipple 40 installed between joints of tubing. Turning to FIG. 3B, the downhole tool 100 is running into the wellbore tubular 17 toward the nipple 40. In this example, the downhole tool 100 is untethered to a downhole conveyance and is run into the wellbore 20, for example, by dropping the downhole tool 100 (to allow gravity to move the downhole tool 100) or forcibly moving the downhole tool 100 downhole with a flow of a wellbore fluid (such as wellbore fluid 200). Alternatively, the downhole tool 100 can be run into the wellbore tubular 17 on a downhole conveyance, such as a slickline or wireline.

Turning to FIG. 3C, the downhole tool 100 has landed on the nipple 40. The hanger 106 can secure the downhole tool 100 in place in the wellbore tubular 17 and the seal 108 fluidly seals the housing 102 of the downhole tool 100 to an inner surface of the wellbore tubular 17. The wellbore fluid 200 can be circulated (or continue to circulate) through the wellbore tubular 17 to the secured downhole tool 100. Due to the seal 108, all or substantially all of the wellbore fluid 200 can flow into the bore 128 of the housing 102 rather than to the nipple 40, around the downhole tool 100. As shown in FIG. 3C, the downhole tool 100 is in the retracted position, as the cutting blades 124 are withdrawn into the housing 102.

Turning to FIG. 3D, as a pressure or flowrate (or both) of the wellbore fluid 200 exceeds a predetermined value, the downhole tool 100 adjusts from the retracted position to the extended position such that the one or more cutting blades 124 extend from the housing 102 to cut the wellbore tubular 17. For example, as the predetermined value is exceeded, the wellbore fluid 200 activates the hydraulic rotor 118 to rotate, thereby rotating the shaft 120. The rotating shaft 120 turns the cutting head 110 (or the cutting blades 124 directly) through the roller bearing 122. Through centrifugal or inertial force, the cutting blade(s) 124 rotate and extend from the cutting head 110 to cut the wellbore tubular 17. Wellbore fluid 200 exits the one or more relief ports 126 into the wellbore tubular 17.

In some aspects, after the wellbore tubular 17 is cut, the flow of the wellbore fluid 200 can be stopped or reduced such that the pressure or flow rate (or both) is below the threshold value. Rotation of the hydraulic rotor 118 can then reduce or stop, thereby reducing the rotation of the shaft 120 and reducing or stopping the centrifugal or inertial force that causes the cutting blade(s) 124 to extend from the housing 102. The downhole tool 100 can then return to the retracted position and, in some aspects, be removed from the wellbore 20 along with the cut piece of wellbore tubing 17.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole tool, comprising:

a housing;

a seal that at least partially circumscribes an external surface of the housing and is configured to fluidly seal the housing against a wellbore tubular positioned in a wellbore that extends from a terranean surface into one or more subterranean formations;

a hydraulic motor assembly positioned in the housing and comprising a hydraulic rotor fluidly coupled to an opening in the housing and a shaft coupled to the hydraulic rotor; and a tubular cutting assembly coupled to the hydraulic motor assembly, the tubular cutting assembly comprising:

a bearing coupled to the shaft; and at least one cutting blade coupled to the bearing and the shaft and operable to cut the wellbore tubular, wherein rotating the shaft in response to a flow of the wellbore fluid through the hydraulic motor assembly turns the at least one cutting blade, wherein the rotation extends the at least one cutting blade through centrifugal force or initial force, and wherein the at least one cutting blade is configured to move through the external surface of the housing to an extended position and rotate in the extended position in response to the flow of wellbore fluid circulated through the hydraulic motor assembly.

2. The downhole tool of claim 1, wherein the housing comprises a hanger assembly configured to attach to an inner surface of the wellbore tubular.

3. The downhole tool of claim 2, wherein the hanger assembly comprises one or more slips.

4. The downhole tool of claim 1, wherein the housing is configured to move through the wellbore untethered to a downhole conveyance.

5. The downhole tool of claim 1, wherein the housing is configured to couple to a downhole conveyance and move through the wellbore attached to the downhole conveyance.

6. The downhole tool of claim 5, wherein the downhole conveyance comprises a wireline or a slickline.

7. The downhole tool of claim 1, wherein the housing comprises a conical downhole end configured to seat into a nipple positioned in the wellbore tubular.

8. The downhole tool of claim 7, wherein the wellbore tubular comprises a production tubular string.

9. The downhole tool of claim 7, further comprising a cutting head that is comprised of the conical downhole end and includes the tubular cutting assembly.

10. The downhole tool of claim 1, wherein the at least one cutting blade is configured to adjust from the extended position to a retracted position within the housing in response to stopping the flow of wellbore fluid causing a decrease in the centrifugal force or inertial force.

11. A method for cutting a wellbore tubular, comprising:

running a downhole tool into a wellbore that extends from a terranean surface into one or more subterranean formations, the downhole tool comprising:

a housing;

a seal that at least partially circumscribes an external surface of the housing;

a hydraulic motor assembly positioned in the housing and comprising a hydraulic rotor fluidly coupled to an opening in the housing and a shaft coupled to the hydraulic rotor; and a tubular cutting assembly coupled to the hydraulic motor assembly, the tubular cutting assembly comprising:

a bearing coupled to the shaft, and at least one cutting blade coupled to the bearing;

moving the downhole tool through the wellbore such that the housing is fluidly sealed against the wellbore tubular with the seal;

circulating a flow of wellbore fluid through the wellbore tubular and to the hydraulic motor assembly through an opening in the housing;

rotating, with the flow of wellbore fluid, the hydraulic rotor to rotate the shaft;

responsive to rotating the shaft by the flow of the wellbore fluid through the hydraulic motor assembly, generating a centrifugal force or inertial force;

extending, by the centrifugal force or inertial force, the at least one cutting blade from an external surface of the housing; and responsive to rotating the shaft by the flow of the wellbore fluid through the hydraulic motor assembly, cutting at least a portion of the wellbore tubular with the extended at least one cutting blade.

12. The method of claim 11, comprising securing the housing to an inner surface of the wellbore tubular with a hanger assembly.

13. The method of claim 12, wherein the hanger assembly comprises one or more slips.

14. The method of claim 11, comprising moving the housing through the wellbore untethered to a downhole conveyance.

15. The method of claim 11, comprising moving the housing through the wellbore attached to the downhole conveyance.

16. The method of claim 15, wherein the downhole conveyance comprises a wireline or a slickline.

17. The method of claim 11, comprising seating a conical downhole end of the housing into a nipple positioned in the wellbore tubular.

18. The method of claim 17, wherein the wellbore tubular comprises a production tubular string.

19. The method of claim 17, wherein the downhole tool further comprises a cutting head that is comprised of the conical downhole end and includes the tubular cutting assembly.

20. The method of claim 11, comprising:

stopping the flow of wellbore fluid through the wellbore tubular and to the hydraulic motor assembly;

responsive to stopping the flow of wellbore fluid to the hydraulic motor assembly, causing a decrease in the centrifugal force or inertial force; and retracting the at least one cutting blade into the housing in response to stopping the flow of wellbore fluid.

* * * * *